US008057168B2

(12) United States Patent
Hsu et al.

(10) Patent No.: US 8,057,168 B2
(45) Date of Patent: Nov. 15, 2011

(54) FAN AND ITS IMPELLER AND HOUSING

(75) Inventors: Wei Chun Hsu, Taoyuan Hsien (TW); Shun Chen Chang, Taoyuan Hsien (TW); Wen Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1213 days.

(21) Appl. No.: 11/364,226

(22) Filed: Mar. 1, 2006

(65) Prior Publication Data

US 2006/0245922 A1 Nov. 2, 2006

(30) Foreign Application Priority Data

Apr. 28, 2005 (TW) ..... 94113692 A

(51) Int. Cl.

| | |
|---|---|
| ***F04D 29/053*** | (2006.01) |
| ***F04D 29/28*** | (2006.01) |
| ***F04D 29/22*** | (2006.01) |
| ***F04D 29/42*** | (2006.01) |
| ***F04D 29/52*** | (2006.01) |

(52) U.S. Cl. ..... 415/206; 415/204; 415/220; 415/229; 416/93 R; 416/181; 416/182; 416/231 R; 416/244 R; 416/185; 417/423.12

(58) Field of Classification Search ..... 415/102, 415/204, 206, 220, 229; 416/93 R, 181, 416/182, 185, 231 R, 244 R; 417/423.12, 417/423.13, 424.1

See application file for complete search history.

(56) References Cited

U.S. PATENT DOCUMENTS

| | | | | |
|---|---|---|---|---|
| 2,116,595 | A * | 5/1938 | Carrey et al. | 415/206 |
| 3,303,995 | A * | 2/1967 | Boeckel | 416/93 R |
| 3,449,605 | A * | 6/1969 | Wilson | 416/93 R |
| 6,000,919 | A * | 12/1999 | Hsieh | 415/220 |
| 6,416,300 | B1 * | 7/2002 | Tang et al. | 417/423.12 |
| 7,106,587 | B2 * | 9/2006 | Liu et al. | 361/697 |
| 7,281,896 | B2 * | 10/2007 | Yu et al. | 416/144 |
| 7,300,262 | B2 * | 11/2007 | Ku et al. | 417/366 |
| 7,455,502 | B2 * | 11/2008 | Spaggiari | 416/93 R |
| 2004/0265125 | A1 * | 12/2004 | Spaggiari | 415/220 |

* cited by examiner

*Primary Examiner* — Christopher Verdier

(74) *Attorney, Agent, or Firm* — Birch, Stewart, Kolasch & Birch, LLP

(57) ABSTRACT

A fan includes an impeller and a housing. The housing includes a base portion and a sidewall portion disposed around and connected with the base portion. A plurality of first recesses are disposed at a connection between the base portion and the sidewall portion, and a rib is disposed between every two adjacent first recesses. The impeller includes a hub having a base portion and a wall portion disposed around and connected with the base portion, and a plurality of blades disposed on a circumference of an outer wall of the wall portion. A plurality of third recesses are disposed at a connection between the base portion of the hub and the wall portion, and a rib is disposed between every two adjacent third recesses. The recesses can prevent the impeller and the housing from the defects and shape deformation caused by injection molding during manufacturing processes, and enhance the structural strength.

10 Claims, 6 Drawing Sheets

1

FIG. 2 (PRIOR ART)
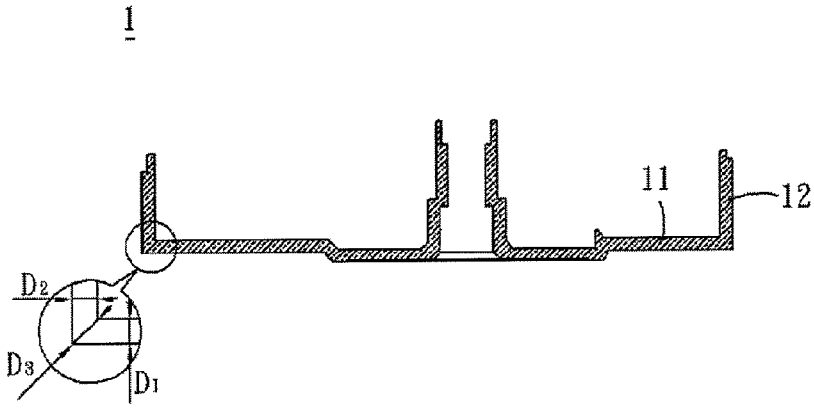
FIG. 2A (PRIOR ART)
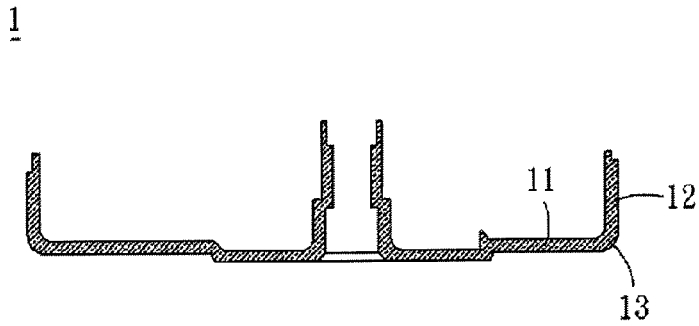
FIG. 3 (PRIOR ART)

FAN AND ITS IMPELLER AND HOUSING

THIS NON-PROVISIONAL APPLICATION CLAIMS PRIORITY UNDER U.S.C. §119(A) ON PATENT APPLICATION NO(S). 094113692 FILED IN TAIWAN, REPUBLIC OF CHINA ON APR. 28, 2005, THE ENTIRE CONTENTS OF WHICH ARE HEREBY INCORPORATED BY REFERENCE.

BACKGROUND OF THE INVENTION

1. Field of Invention

The present invention relates to a fan and its impeller and housing, and in particular, to a fan and its impeller and housing with enhanced structural strength.

2. Related Art

As shown in FIG. 1, a conventional fan housing 1, severing as a base of a fan, includes a base portion 11 and a sidewall portion 12. The sidewall portion 12 is perpendicularly disposed around and connected to the base portion 11.

Generally, the fan housing 1 is made by injection molding. As shown in FIGS. 2 and 2A, the thickness $D_1$ of the base portion 11, the thickness $D_2$ of the sidewall portion 12, and the thickness $D_3$ of the connection between the base portion 11 and the sidewall portion 12 are not the same. As the results, there are defects, such as protrusions and bubbles, which are easily formed at the connection due to non-uniform thickness. Further, non-uniform thickness will cause deformation of the whole shape.

In order to keep the thicknesses $D_1$, $D_2$ and $D_3$ to be uniform and prevent from the shape deformation after injection molding, a conventional solving method is forming, an arc (as shown in FIG. 3) or a groove (not shown) at the connection between the base portion 11 and the sidewall portion 12. However, that weakens the structural strength of the fan housing 1.

Except for the fan housing 1, the impeller of the fan can be also made by injection molding. The same disadvantages, such as the defects and shape deformation, exist caused by injection molding during manufacturing processes.

It is thus imperative to provide a fan and its impeller and housing to solve the above-mentioned problems.

SUMMARY OF THE INVENTION

In view of the foregoing, the present invention is to provide a fan and its impeller and housing for preventing the impeller and the housing from the defects and shape deformation caused by injection molding during manufacturing processes and enhancing structural strength of the impeller and the fan housing.

To achieve the above, a fan housing according to the present invention includes a base portion and a sidewall portion. The sidewall portion is disposed around and is connected with the base portion. A plurality of first recesses are disposed at a connection between the base portion and the sidewall portion. Further, the fan housing has a motor base and a plurality of supporting elements. The motor base is formed by combining the base portion and the sidewall portion, and the supporting elements are connected between the motor base and the fan housing. In addition, the fan housing has a plurality of second recesses and a tube with an axial hole. The tube is disposed on and connected to the base portion, and the second recesses are disposed at a connection between the tube and the base portion. A rib is disposed between every two adjacent first recesses, and a rib is disposed between every two adjacent second recesses. Each of the first and second recess is a blind hole, an indentation or a through hole.

To achieve the above, an impeller according to the present invention includes a hub having a base portion and a wall portion disposed around and connected with the base portion, and a plurality of blades. The blades are disposed on the wall portion and around the hub, and there are a plurality of recesses disposed at a connection between the base portion and the wall portion. A rib is disposed between every two adjacent third recesses. Each of the recesses is a blind hole, an indentation or a through hole. The impeller further includes a shaft, one end of which is connected to the base portion.

To achieve the above, a fan according to the present invention includes a housing and an impeller. The housing includes a base portion and a sidewall portion disposed around and connected with the base portion. A plurality of first recesses are disposed at a connection between the base portion and the sidewall portion. The impeller is disposed within the housing. The impeller includes a hub and a plurality of blades. The hub has a base portion and a wall portion disposed around and connected with the base portion. A plurality of third recesses are disposed at a connection between the base portion and the wall portion. The blades are disposed on the wall portion and around the hub. The housing accommodates the impeller.

As mentioned above, a plurality of recesses are disposed at a connection between the base portion and other portions and a rib is disposed between every two adjacent recesses. Comparing with the conventional structures, a fan and its impeller and housing according to the present invention can prevent the non-uniform thickness at the connection of the impeller and the housing, thereby preventing the defects and shape deformation caused by injection molding during manufacturing processes, and enhancing the structural strength. In addition, the present invention can save the molding material or increase the thickness of the fan housing and the impeller by the saved material. It is thus cost effective.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a cross-sectional view of the conventional fan housing in FIG. 1;

FIG. 2A is a partially enlarged view of FIG. 2;

FIG. 3 is a cross-sectional view of another conventional fan housing;

DETAILED DESCRIPTION OF THE INVENTION

The present invention will be apparent from the following detailed description, which proceeds with reference to the accompanying drawings, wherein the same references relate to the same elements.

Figure 1:
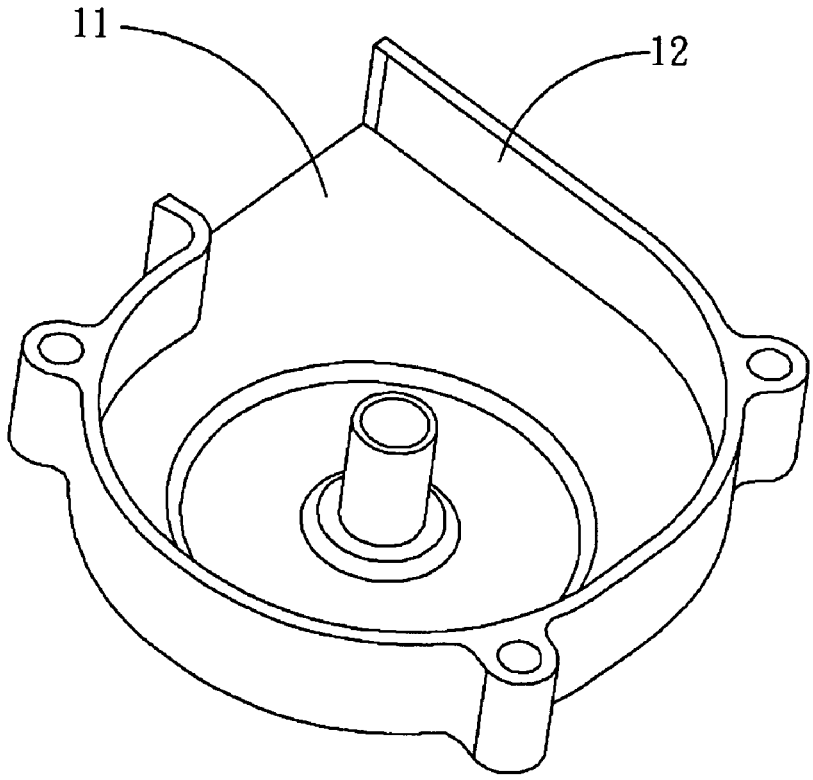
FIG. 1 (PRIOR ART)
FIG. 1 is a three-dimensional view of a conventional fan housing.
Figure 4:
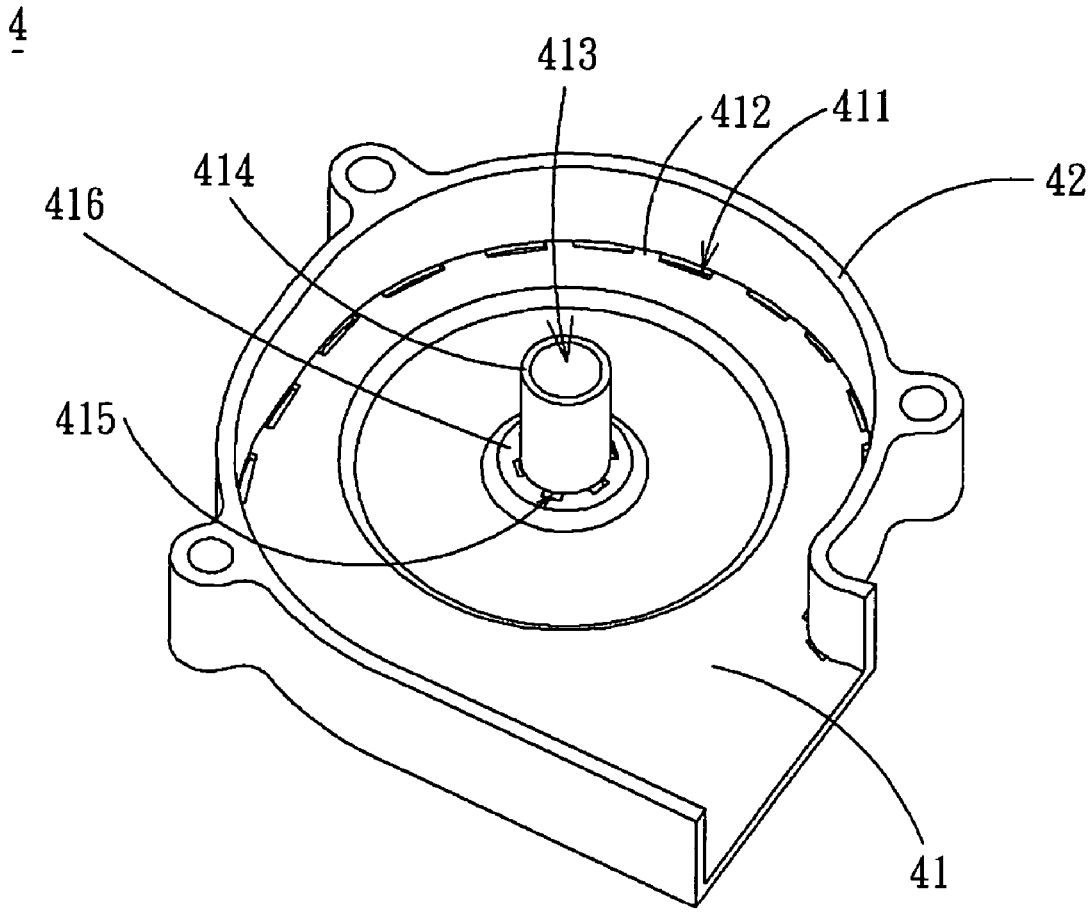
FIG. 4 is a three-dimensional view of a fan housing according to the present invention.
Figures 5, 5A, 5B:
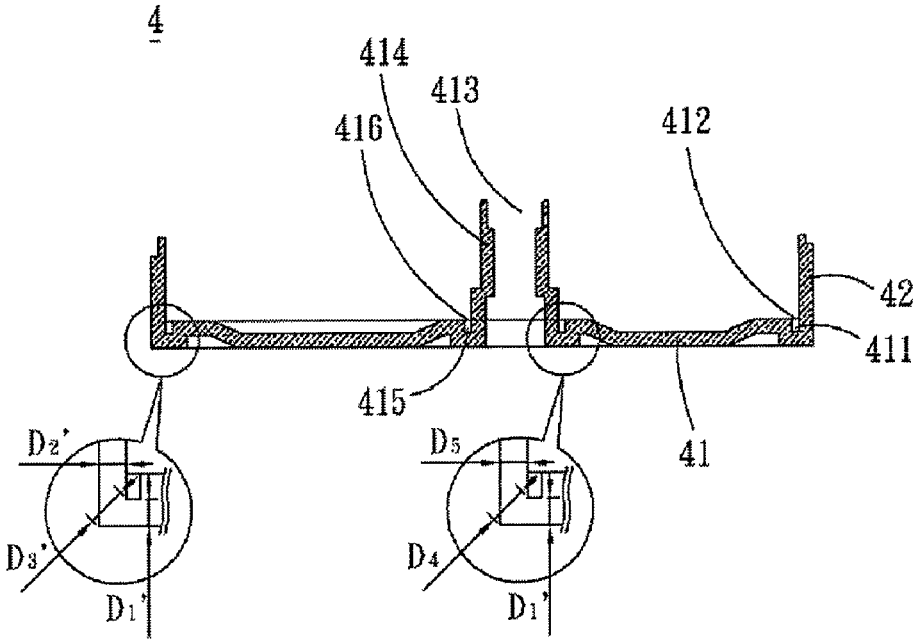
FIG. 5 is a cross-sectional view of the fan housing in FIG. 4.
FIG. 5A is a partially enlarged view of FIG. 5.
FIG. 5B is another partially enlarged view of FIG. 5.

As shown in FIGS. 4 and 5, a fan housing 4 is preferably applied to a centrifugal fan or blower according to the present invention. The fan housing 4 includes a base portion 41 and a sidewall portion 42.

The sidewall portion 42 is disposed around and connected with the base portion 41 in a predetermined angle. In this embodiment, the angle is about 90 degrees. A plurality of recesses 411 are disposed at a connection between the base portion 41 and the sidewall portion 42, and there is a rib 412 disposed between every two adjacent recesses 411.

In addition, the fan housing 4 also has a tube 414 with an axial hole 413 for accommodating the shaft of an impeller therein. The tube 414 is disposed on and connected to the base portion 41 in a predetermined angle, and the second recesses are disposed at a connection between the tube 414 and the base portion. 41. A plurality of recesses 415 are disposed at a connection between the tube 414 and the base portion 41, and there is a rib 416 disposed between every two adjacent recesses 415.

Each of the recesses 411 and 415 is a blind hole or an indentation with a substantial rectangular shape. However, the embodiment is not limited thereto. The recesses 411 and 415 may also be any other shapes with different length or width. In addition, the recesses 411 and 415 may also be designed in different depth or even a through hole in accordance with practical requirements. Thus, the recesses 411 and 415 and the ribs 412 and 416 may have variations with different shape, length, width and depth.

As for the fan housing 4 with special designs of recesses 411 and 415 and the ribs 412 and 416, as shown in FIG. 5A, the thickness $D_1'$ of the base portion 41, the thickness $D_2'$ of the sidewall portion 42, and the thickness $D_3'$ of the connection between the base portion 41 and the sidewall portion 42 are substantially the same because the recesses 411 are disposed between the base portion 41 and the sidewall portion 42. Also, as shown in FIG. 5B, the thickness $D_1'$ of the base portion 41, the thickness $D_4$ of the connection between the base portion 41 and the tube 414, and the thickness $D_5$ of the tube 414 are substantially the same because the recesses 415 are disposed between the tube 414 and the base portion 41. Therefore, the present invention can prevent the fan housing from the defects and shape deformation caused by injection molding during manufacturing processes. The ribs 412 and 416 can further enhance the structural strength at the connection between the base portion 41 and the sidewall portion 42, and at the connection between the base portion 41 and the tube 414. Comparing with the conventional structures, it solved the problems of defects and shape deformation caused by injection molding during manufacturing processes.

Further, considering the material consumption of injection molding, the material can be saved by the recesses at the connections between the base portion 41 and the sidewall portion 42, and between the tube 414 and the base portion 41. The present invention is thus cost effective, comparing with the conventional structures. Alternately, the thickness of the base portion 41, the sidewall portion 42 and the tube 414 can be increased by the saved material. Therefore, the structural strength of the fan housing is thus enhanced.

Figure 6:
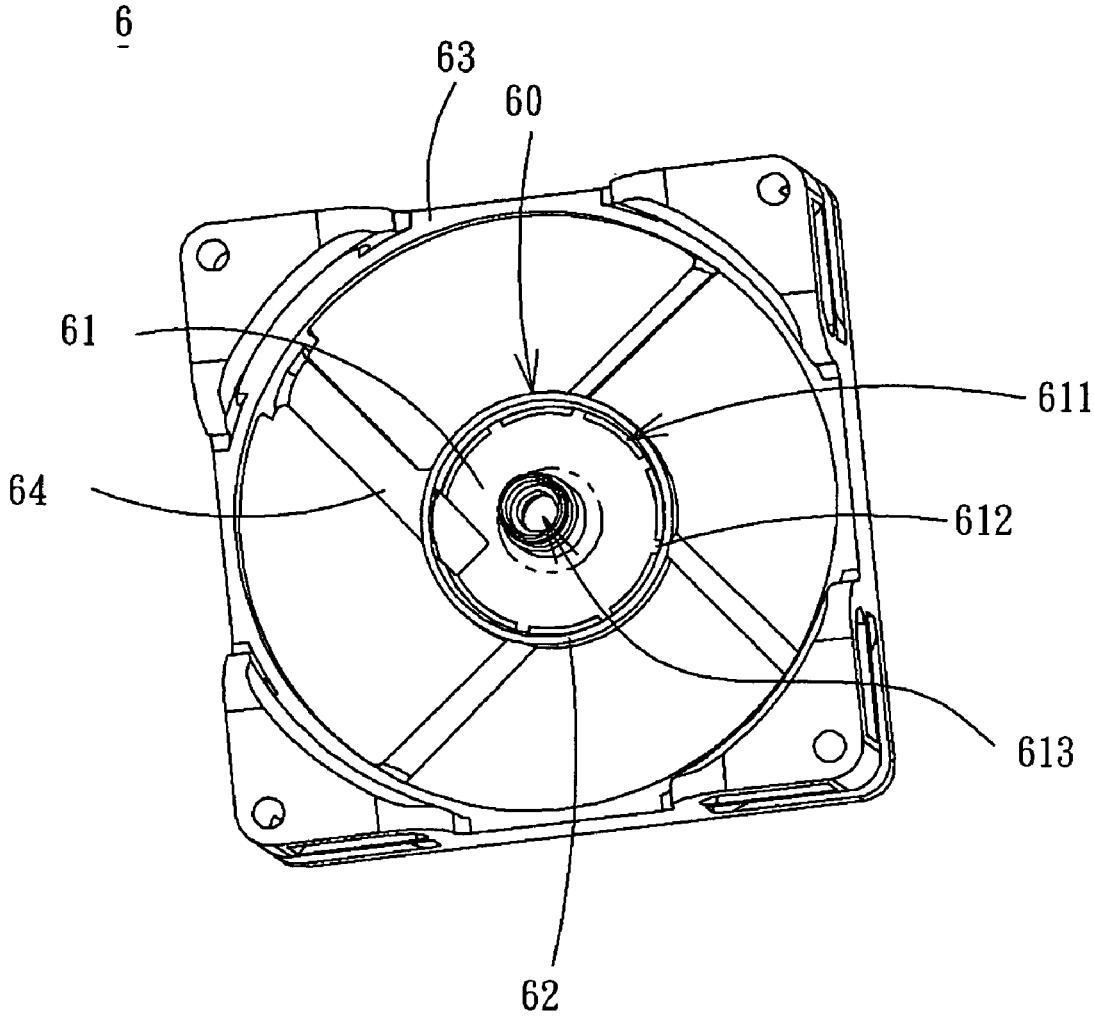
FIG. 6 is a three-dimensional view of another fan housing according to the present invention.

The present invention is not limited to the above-mentioned fan housing of the centrifugal fan. As shown in FIG. 6, a fan housing 6 may also be applied to an axial fan. The fan housing 6 includes a motor base 60, a frame portion 63 and a plurality of supporting elements 64. The supporting elements 64 are connected between the motor base 60 and the frame portion 63 for supporting the motor base 60. The motor base 60 is formed by a base portion 61 and a sidewall portion 62. The sidewall portion 62 is disposed around and connected with the base portion 61 in a predetermined angle, such as 90 degrees. A plurality of recesses 611 are disposed at a connection between the base portion 61 and the sidewall portion 62, and there is a rib 612 disposed between every two adjacent recesses 611. In addition, a plurality of recesses may be disposed at a connection between the tube 613 and the base portion 61, and there is a rib disposed between every two adjacent recesses as the similar manner described in FIG. 4. The detail descriptions are omitted herein.

Figure 7:
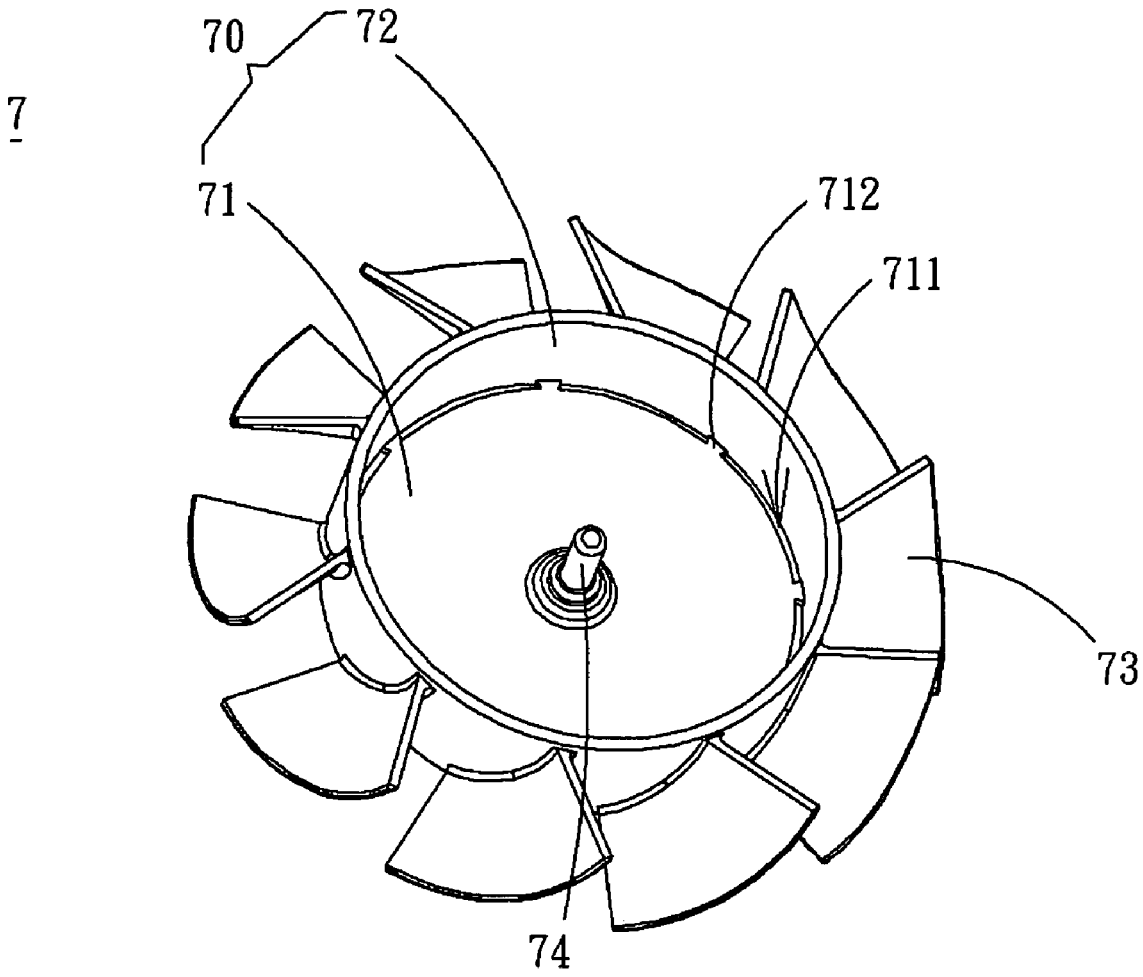
FIG. 7 is a three-dimensional view of an impeller according to the present invention.

As shown in FIG. 7, an impeller 7 is disposed on the motor base 60 of the fan housing 6 in FIG. 6. The impeller 7 has a shaft 74 disposed in the tube 613 of the fan housing 6 in FIG. 6 and driven by a motor (not shown) to rotate. The impeller 7 includes a hub 70 and a plurality of blades 73. The hub 70 has a base portion 71 and a wall portion 72, and the blades 73 are disposed on the wall portion 72 and around the hub 70. One end of the shaft 74 is connected to the base portion 71 of the hub 70. The wall portion 72 is disposed around and connected with the base portion 71 in a predetermined angle. A plurality of recesses 711 are disposed at a connection between the base portion 71 and the wall portion 72, and there is a rib 712 disposed between every two adjacent recesses 711.

Except for the connection between the base portion and the sidewall portion, the connection between the tube and the base portion of the fan housing, and the connection between the base portion and the wall portion of the impeller having the recesses, a plurality of recesses may also be disposed at a connection between a protruding portion and the base portion when the base portion has the protruding portion, and also a rib is formed between every two adjacent recesses. That is, when any two walls of the fan housing or the impeller are connected with an angle, the structure disclosed in the present invention can be applied to any structures having connections, thereby preventing the non-uniform thickness at the connection and the walls. Also, it prevents the impeller and the fan housing from the defects and shape deformation caused by injection molding during manufacturing processes and enhances the structural strength.

The present invention also provides a fan having a housing and an impeller which is disposed within the housing. The shaft of the impeller is disposed in the tube with an axial hole and is driven by a motor to rotate. The housing and the impeller have the same constructions and functions as those described herein above. The detail descriptions are omitted herein.

In summary, a plurality of recesses are disposed at a connection between the base portion and other portions and a rib is disposed between every two adjacent recesses. Comparing with the conventional structures, a fan and its impeller and housing according to the present invention can prevent the non-uniform thickness at the connection of the impeller and the housing, whereby preventing the defects and shape deformation caused by injection molding during manufacturing processes, and enhancing the structural strength. In addition, the present invention can save the molding material or increase the thickness of the fan housing and the impeller by the saved material. It is thus cost effective.

Although the present invention has been described with reference to specific embodiments, this description is not meant to be construed in a pivoting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan housing, comprising:

a base portion with a tube;

a sidewall portion disposed around and connected with the base portion; wherein a plurality of first blind holes and a plurality of first ribs are disposed at an inner side of a connection corner connecting the base portion and the sidewall portion along a periphery of the base portion, the first blind holes are located inside the sidewall portion and the base portion, and a corresponding one of the first ribs is disposed between every two immediately adjacent first blind holes; and a plurality of second recesses and the tube with an axial hole, wherein the tube is disposed on and connected to the base portion, and the second recesses are disposed at a connection between the tube and the base portion, wherein a rib is disposed between every two adjacent second recesses, and each of the second recesses is a blind hole.

2. The fan housing according to claim 1, further comprising a motor base and a plurality of supporting elements connected between the motor base and the fan housing.

3. The fan housing according to claim 1, wherein the cross-section of the base portion, one of the blind holes and the sidewall portion has a shape of an L-shaped hood.

4. A fan, comprising:

a housing comprising a base portion with a tube and a sidewall portion disposed around and connected with the base portion, wherein a plurality of first blind holes and a plurality of first ribs are disposed at an inner side of a connection corner connecting the base portion and the sidewall portion along a periphery of the base portion , the first blind holes are located inside the sidewall portion and the base portion, and two ends of a corresponding one of the first ribs are respectively connected with every two immediately adjacent first blind holes, the housing further comprises a plurality of second ribs, a plurality of second blind holes and the tube with an axial hole, the tube is disposed on and connected to the base portion, and the second blind holes are disposed at an inner side of a connection corner connecting the tube and the base portion, two ends of a corresponding one of the second ribs are respectively connected with every two immediately adjacent second blind holes; and an impeller, disposed within the housing.

5. The fan according to claim 4, wherein the housing further comprises a motor base and a plurality of supporting elements connected between the motor base and the housing.

6. The fan according to claim 4, wherein the impeller comprises a hub and a plurality of blades, the hub has a base portion and a wall portion disposed around and connected with the base portion, a plurality of third recesses are disposed at a connection between the base portion of the hub and the wall portion, and the blades are disposed on the wall portion and around the hub.

7. The fan according to claim 6, wherein a rib is disposed between every two adjacent third recesses.

8. The fan according to claim 7, wherein each of the third recesses is a blind hole.

9. The fan according to claim 8, wherein the impeller further comprises a shaft, one end of which is connected to the base portion of the hub.

10. The fan according to claim 4, wherein the cross-section of the base portion, one of the blind holes and the sidewall portion has a shape of an L-shaped hood.

* * * * *